US005655300A

United States Patent [19]

Gruppach

[11] Patent Number: 5,655,300

[45] Date of Patent: Aug. 12, 1997

[54] METHOD OF MAKING STAMPATO JEWELRY

[75] Inventor: Orfeo Gruppach, Vicenza, Italy

[73] Assignee: G&C, Inc., Boston, Mass.

[21] Appl. No.: 383,419

[22] Filed: Feb. 3, 1995

[51] Int. Cl.[6] ..... B21F 43/00

[52] U.S. Cl. ..... 29/896.411; 29/896.41; 59/35.1; 59/80; 63/4; 63/33

[58] Field of Search ..... 29/896.41, 896.411, 29/894.43; 63/2, 4; 59/13, 14, 15, 35.1, 80

[56] References Cited

U.S. PATENT DOCUMENTS 215,235 5/1879 Miller ..... 29/896.41

2,518,163 8/1950 Megar ..... 59/80

2,775,093 12/1956 Kundert ..... 63/4

4,625,508 12/1986 Fontana ..... 59/80

*Primary Examiner*—P. W. Echols

*Attorney, Agent, or Firm*—Fish & Richardson, P.C.

[57] ABSTRACT

A process of forming a metal stampato jewelry piece includes stamping a sheet of metal to produce a hollow front section of a desired shape; stamping a sheet of metal to produce a back section including a ledge defining an opening, the ledge having an outer periphery substantially corresponding to an outer periphery of the front section; and soldering the front section and the back section together such that the ledge outer periphery and the front section outer periphery are substantially aligned. The ledge imparts durability and sufficient rigidity to the stampato pieces to enable joining of the pieces by pins.

11 Claims, 2 Drawing Sheets

METHOD OF MAKING STAMPATO JEWELRY

BACKGROUND OF THE INVENTION

This invention relates to stampato jewelry.

It has been known to produce stampato jewelry, such as that shown in FIGS. 1 and 1*a*, by stamping a sheet of metal to make a front section 12 of a desired shape, soldering the front section to a sheet of metal, and stamping the soldered assembly to create a stampato piece 14 having a solid back 16. The stampato pieces are then joined by pins 18.

SUMMARY OF THE INVENTION

The invention features a stampato jewelry piece in which the back section is not solid but rather is in the form of a ledge. The stampato piece is sufficiently durable for normal use and sufficiently rigid to enable joining of adjacent pieces by pins. The stampato piece also is relatively light and inexpensive to produce.

The invention further features a process of forming a metal stampato jewelry piece. The process includes (1) stamping a sheet of metal to produce a hollow front section of a desired shape; (2) stamping a sheet of metal to produce a non-solid back section including a ledge defining an opening, the ledge having an outer periphery substantially corresponding to an outer periphery of the front section; and (3) soldering the front section and the back section together so that the ledge outer periphery and the front section outer periphery are substantially aligned.

The front section may include a front frame around the front section outer periphery and the back section may include a back frame around the ledge outer periphery. The frames may be removed by stamping after the front and back sections are soldered together.

The back frame may be indented to form a seating surface substantially corresponding to the front frame. The seating surface aligns the front section on the back section before soldering. Alternatively, the back frame may include tongues positioned to align the front section on the back section before soldering.

The back section may include a back frame around the ledge while the front section does not include a frame. The ledge is angled with respect to the back frame and forms a seating surface for aligning the front section on the back section before soldering. The assembly is stamped after soldering to remove the back frame and flatten the ledge.

A plurality of the metal stampato jewelry pieces are made with holes in the pieces, the pieces are joined by pins to produce a piece of jewelry.

Other features and advantages of the invention will be apparent from the description of the preferred embodiments thereof, and from the claims.

BRIEF DESCRIPTION OF THE DRAWINGS

FIG. 4*a* is a front view of a front section aligned with a back section.

DESCRIPTION OF THE PREFERRED EMBODIMENTS

Figure 1:
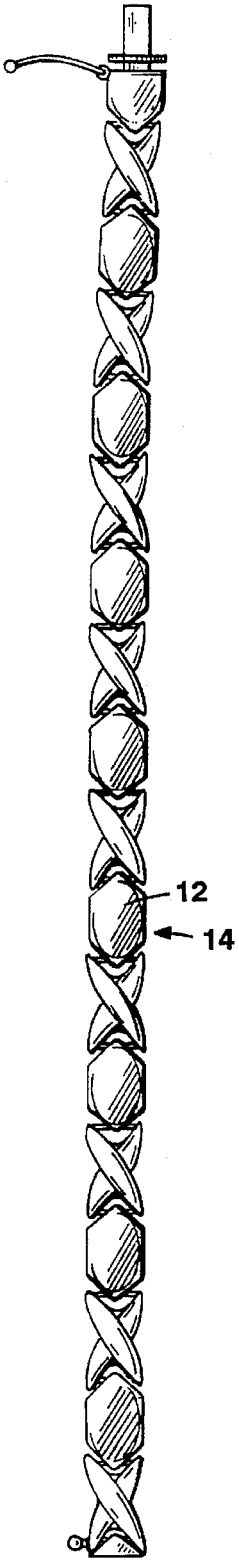
FIG. 1 PRIOR ART
FIGS. 1–1*a* are front and back views, respectively, of a prior art stampato bracelet.
Figure 1A:
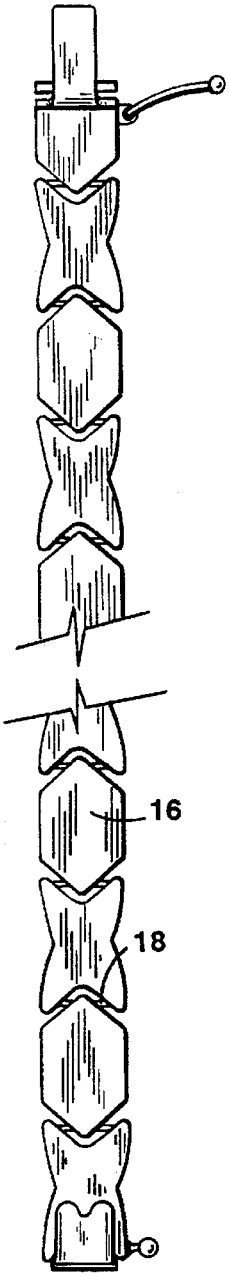
FIG. 1a PRIOR ART
Figure 2:
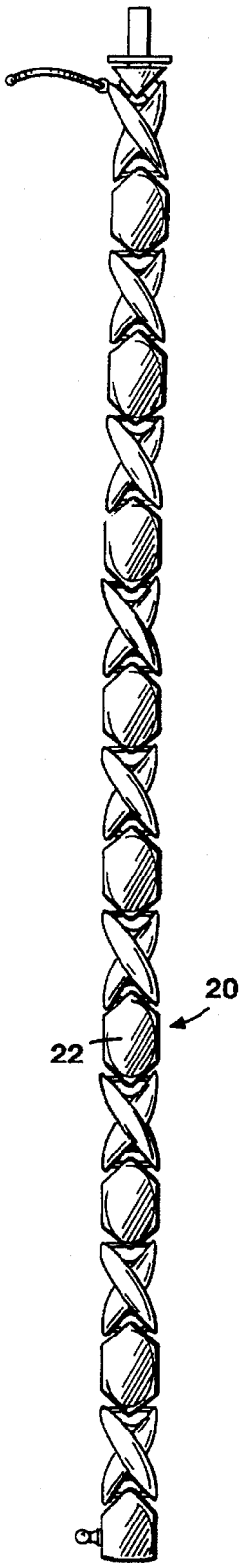
FIG. 2 is a front view of a stampato bracelet according to the invention.
Figure 2A:
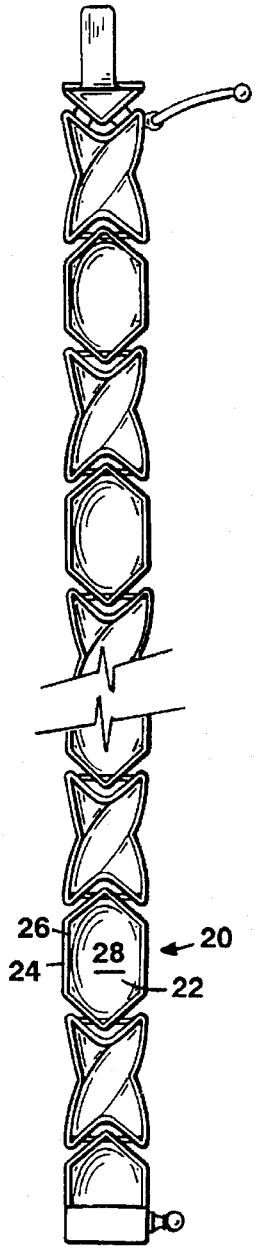
FIGS. 2*a* and 2*b* are rear views of a stampato bracelet according to the invention.

Referring to FIGS. 2 and 2*a*, a stampato jewelry piece 20, formed from, e.g., gold, silver, platinum, or gold plated silver, includes a hollowed front section 22 of a desired shape, and a back section 24 including an overhanging ledge 26 about 0.7 mm to 1.5 mm wide, preferably about 1 mm wide, defining an opening 28. The size of opening 28 is smaller than the outer periphery of the desired shape of front section 22, encompassing not less than about 40% of the back section, and preferably not less than about 70%. Piece 20 can be, e.g., about 5 mm to 20 mm in diameter.

Figure 2B:
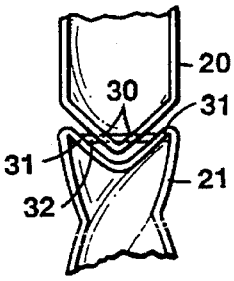

Referring to FIG. 2*b*, a piece of jewelry can be formed by placing holes 30 in a first stampato piece 20 and holes 31 in an adjacent stampato piece 21 by, e.g., drilling or other conventional methods, and joining adjacent pieces 20, 21 with pin 32. Ledge 26 imparts durability to piece 20 to withstand crushing loads that may be applied during normal use and sufficient rigidity to the pieces to enable their joining by pins.

There are several preferred methods of forming a stampato jewelry piece like piece 20.

Figure 3:
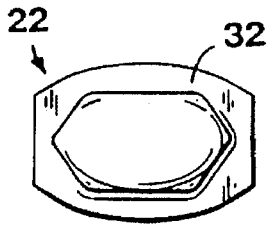
FIGS. 3, 4, and 5 are front views of intermediates to a front section.
Figure 3A:
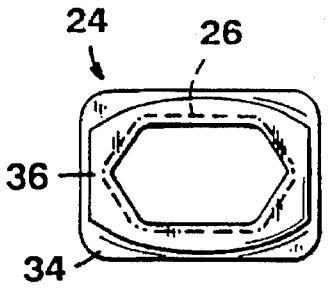
FIGS. 3*a*, 4*a*, and 5*a* are front views of intermediates to a back section.
Figure 4:
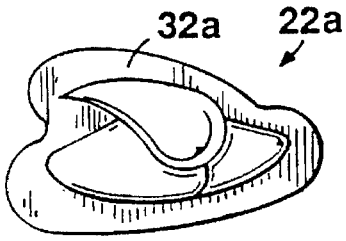
Figure 4B:
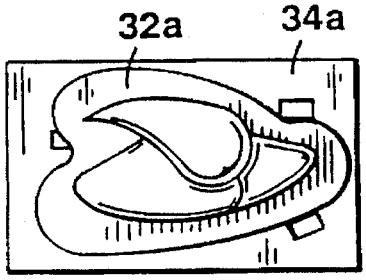
Figure 4A:
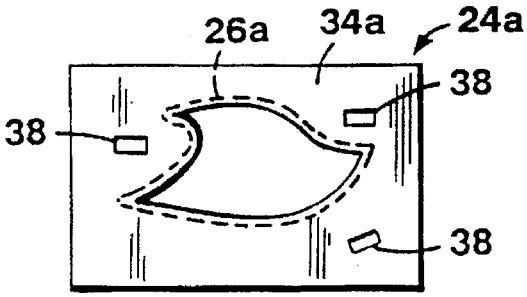

Referring to FIGS. 3 and 3*a*, stampato jewelry piece 20 is formed by stamping a sheet of metal, e.g., 0.2 mm to 0.6 mm thick, preferably about 0.3 mm to 0.4 mm thick, gold sheet, to produce hollow front section 22 including a front frame 32. Back section 24 is also stamped from sheet metal, e.g., 0.2 mm to 0.6 mm thick, preferably about 0.3 mm to 0.4 mm thick, gold sheet, and includes a back frame 34 indented as at 36 to form a seating surface corresponding to front frame 32 to align front section 22 on back section 24 before soldering. Sections are soldered together so that the outer periphery of ledge 26 and the outer periphery of the front section are substantially aligned, and the assembly is stamped to remove frames 32, 34.

referring to FIGS. 4–4*b*, alternatively a stampato jewelry piece is formed by stamping a sheet of metal to produce a front section 22*a*, including front frame 32*a*. Another sheet of metal is stamped to produce back section 24*a* including back frame 34*a* and tongues 38. The tongues are positioned to align front section 22*a* on back section 24*a* before soldering. After soldering, the assembly is stamped to remove frames 32*a*, 34*a*.

Figure 5:
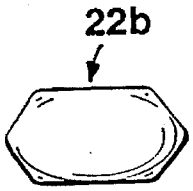
Figure 5A:
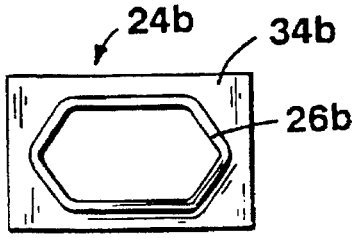

Referring to FIGS. 5 and 5*a*, alternatively a stampato jewelry piece is formed by stamping a sheet of metal to produce a front section 22*b*, which does not include a frame. Another sheet of metal is stamped to produce back section 24*b*, which includes frame 34*b*. Ledge 26*b* of back section 24*b* is initially at an angle. (angled away as viewed from the front) with respect to frame 34*b* to form a seating surface for aligning front section 22*b* on back section 24*b* before soldering. During the final stamping to remove frame 34*b*, ledge 26*b* is flattened.

Holes 30, 31 for joining the stampato pieces can be made at anytime during the process, preferably before soldering the front and back sections together. Referring again to FIG. 2*b*, pin 32 is soldered in place in holes 31 and is free floating within holes 30.

Other embodiments are within the scope of the following claims.

What is claimed is:

1. A process of forming a metal stampato jewelry piece including a hollow front section and a back section, said process including:

stamping a sheet of metal to produce a hollow front section of a desired shape, said hollow front section having an outer periphery, stamping a sheet of metal to produce a back section comprising a ledge defining an opening extending through said back section, said ledge having an outer periphery substantially corresponding to said outer periphery of said front section, drilling holes in said hollow front section for the placement of pins, and soldering said front section and said back section together so that said outer periphery of said ledge and said outer periphery of said front section are substantially aligned.

2. The process of claim 1 wherein said ledge is of uniform width.

3. The process of claim 2 wherein said ledge width is in the range of about 0.7 mm to 1.5 mm.

4. The process of claim 3 wherein said ledge width is about 1 mm.

5. The process of claim 1 wherein said ledge outer periphery defined the area of said back section and said ledge covers no more than about 50% of said area.

6. The process of claim 5 wherein said ledge covers no more than about 20% of said area.

7. The process of claim 1 wherein said front section further includes a front frame around the outer periphery of said front section and said back section further includes a back frame around the outer periphery of said ledge, the process further including stamping after soldering to remove said frames.

8. The process of claim 7 wherein said back frame is indented to form a seating surface substantially corresponding to said front frame, said seating surface aligning said front section on said back section before soldering.

9. The process of claim 7 wherein said back frame further includes tongues positioned to align said front section on said back section before soldering.

10. The process of claim 1 wherein said back section further includes a back frame around said ledge, said back frame being substantially flat and said ledge being angled with respect to said back frame, said angled ledge forming a seating surface for aligning said front section on said back section before soldering, the process further including stamping after soldering to remove said back frame.

11. The process of claim 1, further including:

making a plurality of said metal stampato jewelry pieces, and joining said pieces by pins.

* * * * *